US009279256B2

(12) United States Patent
Greaves et al.

(10) Patent No.: US 9,279,256 B2
(45) Date of Patent: Mar. 8, 2016

(54) TREAD MODULE

(75) Inventors: John Greaves, Romsey (GB); Martin Roberts-Jones, Chandlers Ford (GB)

(73) Assignee: KEE SAFETY LIMITED, Reading (GB)

( * ) Notice: Subject to any disclaimer, the term of this patent is extended or adjusted under 35 U.S.C. 154(b) by 400 days.

(21) Appl. No.: 13/514,213

(22) PCT Filed: Dec. 6, 2010

(86) PCT No.: PCT/GB2010/002221
§ 371 (c)(1), (2), (4) Date: Jul. 11, 2012

(87) PCT Pub. No.: WO2011/070314
PCT Pub. Date: Jun. 16, 2011

(65) Prior Publication Data

US 2012/0266551 A1 Oct. 25, 2012

(30) Foreign Application Priority Data

Dec. 7, 2009 (GB) ..... 0921366.1

(51) Int. Cl.
*E04D 13/12* (2006.01)
*E04F 15/22* (2006.01)
(Continued)

(52) U.S. Cl.
CPC . *E04D 13/12* (2013.01); *E04B 5/43* (2013.01); *E04F 15/10* (2013.01); *E04F 15/22* (2013.01); *E06C 1/345* (2013.01); *E04D 2001/308* (2013.01)

(58) Field of Classification Search
CPC ... E04D 13/12; E04D 2001/308; E04C 1/345; E04C 5/20; E04C 13/045; E04C 2201/16; E04C 11/24; E04F 15/10; E04F 15/22; E04F 17/00; E04F 2011/0218; E01C 5/20; E01C 13/045; E01C 2201/12; E01C 2201/16; E04B 5/43; E04B 5/02; E06C 1/345; E04G 21/30; Y10T 428/16
USPC ..... 52/177, 179, 182, 183, 188, 582.1, 52/582.2, 581, 98, 100, 650.3; 404/34, 35, 404/36, 37, 38, 41; 405/229, 258.1, 302.4, 405/302.5, 302.6, 303; 403/364, 339, 321; 14/69.5; 182/228.1, 228.2, 228.3, 182/228.4
See application file for complete search history.

(56) References Cited

U.S. PATENT DOCUMENTS 3,511,001 A * 5/1970 Morgan, Jr. ..... 52/126.5
3,909,996 A * 10/1975 Ettlinger et al. ..... 52/177
(Continued)

FOREIGN PATENT DOCUMENTS

EP 0016534 10/1980
JP 2002364156 12/2002
(Continued)

OTHER PUBLICATIONS

International search report dated Mar. 29, 2011 in corresponding PCT/GB2010/002221.
(Continued)

*Primary Examiner* — Robert Canfield
*Assistant Examiner* — Matthew Gitlin
(74) *Attorney, Agent, or Firm* — Young & Thompson

(57) ABSTRACT

A tread module (10) for a walkway or stairway includes a body of material which defines a load-carrying surface (14), the tread module including at least two sub-module sections (20,21,22) which are formed integrally with one another and inter-connected by at least one severable formation (23) whereby the tread module may be reduced in size by severance of the severable formation(s).

21 Claims, 5 Drawing Sheets

(51) Int. Cl.

| | |
|---|---|
| ***E04B 5/43*** | (2006.01) |
| ***E04F 15/10*** | (2006.01) |
| ***E06C 1/34*** | (2006.01) |
| *E04D 1/30* | (2006.01) |

(56) References Cited

U.S. PATENT DOCUMENTS

| | | | | |
|---|---|---|---|---|
| 4,436,779 | A * | 3/1984 | Menconi et al. | 428/169 |
| 4,584,221 | A * | 4/1986 | Kung | 428/44 |
| 4,749,302 | A * | 6/1988 | DeClute | 404/37 |
| 4,826,351 | A * | 5/1989 | Haberhauer et al. | 404/35 |
| 5,028,072 | A * | 7/1991 | Lindsay | 280/789 |
| 5,349,795 | A | 9/1994 | French et al. | |
| 5,500,267 | A | 3/1996 | Canning | |
| 5,509,244 | A * | 4/1996 | Bentzon | 52/387 |
| 5,527,128 | A * | 6/1996 | Rope et al. | 404/35 |
| 5,628,160 | A * | 5/1997 | Kung | 52/591.1 |
| 5,787,654 | A * | 8/1998 | Drost | 52/177 |
| 5,992,106 | A * | 11/1999 | Carling et al. | 52/177 |
| 6,467,224 | B1 * | 10/2002 | Bertolini | 52/177 |
| 6,751,912 | B2 * | 6/2004 | Stegner et al. | 52/177 |
| 7,527,451 | B2 * | 5/2009 | Slater et al. | 404/36 |
| 7,571,572 | B2 * | 8/2009 | Moller, Jr. | 52/177 |
| 7,571,573 | B2 * | 8/2009 | Moller, Jr. | 52/177 |
| 7,918,057 | B2 * | 4/2011 | Moller, Jr. | 52/177 |
| 8,028,491 | B2 * | 10/2011 | Flaherty et al. | 52/747.11 |
| 8,225,566 | B2 * | 7/2012 | Prevost et al. | 52/302.1 |
| 8,266,849 | B2 * | 9/2012 | Bravo et al. | 52/177 |
| 8,266,857 | B2 * | 9/2012 | David | 52/385 |
| 8,341,896 | B2 * | 1/2013 | Moller et al. | 52/181 |
| 8,397,466 | B2 * | 3/2013 | Jenkins et al. | 52/745.11 |
| 8,407,951 | B2 * | 4/2013 | Haney et al. | 52/177 |
| 8,424,257 | B2 * | 4/2013 | Jenkins et al. | 52/177 |
| 8,505,256 | B2 * | 8/2013 | Cerny et al. | 52/403.1 |
| 2003/0037990 | A1 * | 2/2003 | Testa, Jr. | 182/45 |
| 2004/0258869 | A1 * | 12/2004 | Walker | 428/44 |
| 2005/0034395 | A1 * | 2/2005 | Kotler | 52/384 |
| 2005/0193669 | A1 * | 9/2005 | Jenkins et al. | 52/392 |
| 2005/0252109 | A1 * | 11/2005 | Fuccella et al. | 52/177 |
| 2006/0117688 | A1 * | 6/2006 | Hauck | 52/302.1 |
| 2009/0031658 | A1 * | 2/2009 | Moller et al. | 52/403.1 |
| 2009/0071090 | A1 | 3/2009 | Yang | |
| 2009/0094907 | A1 * | 4/2009 | Denicolo | 52/188 |
| 2009/0094918 | A1 * | 4/2009 | Murphy et al. | 52/387 |
| 2009/0139160 | A1 * | 6/2009 | Hill | 52/177 |

FOREIGN PATENT DOCUMENTS

| | | |
|---|---|---|
| JP | 2007211419 | 8/2007 |
| JP | 2009144461 | 7/2009 |
| WO | 9511657 | 5/1995 |

OTHER PUBLICATIONS

British search report dated Mar. 11, 2010 in corresponding GB 0921366.1.

* cited by examiner

SECTION A - A
26
24
29
24
Z
Y

SECTION B - B
24
9
16
14
12
18
19
17

SECTION C - C
29
23
23
14
23
29
Z
X

SECTION D - D
24
14

TREAD MODULE

BACKGROUND OF THE INVENTION

1. Field of the Invention

This invention relates to a tread module for use in constructing an internal or external walkway or stairway and to a walkway or stairway incorporating said tread module.

2. Description of the Related Art

There is a particular need to protect roof structures from damage by maintenance and other personnel moving thereover, and to assist in ensuring the safety of such personnel. Such needs include also the provision of roof-top fire escape routes. In response to these needs it is well known, particularly for industrial and commercial premises, to construct on a roof top both continuous walkways, which may be level or slightly inclined, and also series of steps in the form of stairways for movement of personnel over more steeply inclined surfaces.

The variety of roof pitch angles and the distances over which a walkway is to be provided means that in general bespoke on-site construction work is necessary. However the relative difficulties typically encountered when working in a roof top environment, and exposure to weather, makes it particularly advantageous to provide means for minimising or simplifying the on-site construction work.

Another requirement which needs to be taken into account is that of ensuring that the tread surface does not of itself present a significant safety hazard.

Disadvantages of many known walkway systems include difficulty of and time for on-site construction, relative expense, cost of component parts and relatively high weight.

BRIEF SUMMARY OF THE INVENTION

The present invention seeks to provide an improved walkway or stairway and an improved tread module for a walkway or stairway in which at least some of the aforementioned disadvantages of known types of installations and components therefor are mitigated or overcome.

The present invention seeks in another of its aspects to provide a tread module which facilitates relative ease of installation.

The present invention seeks in yet another of its aspects to provide a tread module which takes account of the need not to present a significant safety hazard.

In accordance with one aspect of the present invention there is provided a tread module for a walkway or stairway and comprising a body of a material, such as moulded or cast material, which defines a load carrying surface, said body incorporating any one or any combination of any two or more of the features described below.

The body may be moulded from a plastics material such as a polyamide (e.g. nylon) or a composite such as glass reinforced polyamide. Other suitable materials include cast aluminium.

The body preferably is substantially rigid thereby to resist significant deflection in at least one and preferably each of two mutually perpendicular directions.

The body preferably is provided with a plurality of apertures which extend through the body from the load carrying surface. At least some of the apertures may be intended, in use of the tread module, to act as drainage channels for drainage of rain water from the load carrying surface.

Additionally or alternatively at least some of said apertures may be adapted to locate retention means by which the tread module may be secured to a supporting structure such as part of a roof or a support secured to roof. Said apertures may be adapted to accommodate and provide a reaction surface for the head of retention means, such as a bolt, tapered pin or self-tapping screw, whereby the retention means does not need to protrude above the load carrying surface. Thus, for example, a retention aperture may be of a wedge-like shape in longitudinal cross-section; it may define a frusto-conical shaped surface the diameter of which decreases in a direction away from the load carrying surface, or it may be of a stepped cross-section thereby to define between ends of the aperture an annular abutment surface which lies in a plane substantially parallel with the load carrying surface.

The body of material defining the load carrying surface, and any apertures extending therethrough, may be substantially solid as considered in the thickness direction of the tread module, that being a direction substantially perpendicular to the load carrying surface. However to minimise weight and cost of materials, whilst preserving a sufficient rigidity and resistance to deflection, the body preferably comprises at least one recess which is open to an underside surface of the body, that underside surface being substantially parallel with the load carrying surface. Apertures, if provided, may be defined by moulded or cast tubular formations such that the or each of a plurality of recesses is defined by the space(s) between the tubular formations. Ends of at least some of the apertures may define at least in part said underside surface of the body.

The body may comprise a flange like edge formation which extends in the form of a skirt from at least a part of the periphery of the load carrying surface such that a recess region is defined by an underside of the load carrying surface and the edge formation(s). The edge formation(s) may define at least in part an underside surface of the body.

The body of the tread module may comprise at least two sub module sections which may be formed integrally with one another and inter-connected by at least one severable formation whereby a tread module may be reduced in size by severance of the or each of the severable formations.

The severable formations may, for example, be provided substantially midway between two parallel, opposite edges of a body of a substantially square or rectangular shape such that severance of the severable formations results in two tread sub modules of equal dimension, at least as considered in a direction between said opposite edges. Thus, typically, there may result two sections of identical shape and size. However, it may be advantageous to provide the severable formation(s) in an off-set position such that the tread module may be divided to provide two sub-modules of different sizes. It is further envisaged that a tread module may be severable to provide three or more sections. For example, it may comprise three sections each severable from one another and which may each be of substantially identical size and shape such that the module may be employed to provide either two sub-modules one of two thirds the depth and the other one third of the depth of the original module, or three sub modules each one third of the depth of the original module, the term depth being used herein to refer to the direction of the tread module between the opposite module edges which are separable from one another.

Typically the tread module for a stairway is of a substantially rectangular shape having a width greater than depth. The present invention envisages that advantageously the tread module may be severable into two or more sub module sections each having a greater width to depth ratio than that of the module from which they are formed. Accordingly the tread module may be employed to provide a sub-module of a size which may be employed to complete a length of walkway which is not an exact multiple of the depth of each module.

Similarly, for the provision of a steep stairway the module may be reduced in depth to provide stair tread sections of an appropriate, smaller depth.

For a tread module comprising a body severable to form at least two sub module sections each of the severable sections may be provided with a flange-like edge formation which extends from at least a part and preferably the whole of the periphery of the load carrying surface of that section such that a recess region is defined by an underside of that part of the module and the associated flange formation. However, in the case of a tread module which is not of a severable type it is preferred that if a flange-like edge formation is provided, it extends from at least the whole of the periphery of the load carrying surface such that, in common with the provision of a flange around the whole periphery of a severable section, there results a beneficial stiffening effect to assist in resisting deflection under the action of a load supported by the load carrying surface of the module.

Preferably the body of the tread module comprises both a plurality of apertures and a peripherally continuous flange formation (or a plurality of peripherally continuous flange formations in the case of a tread module comprising two or more separable sections), with reinforcing web sections extending between neighbouring apertures and/or between apertures and the flange formation which at least in part surrounds said aperture(s) thereby to provide an enhanced reinforcing effect and resistance to deflection of the tread module when the load carrying surface is subjected to an applied load.

At least one edge of the tread module may be provided with at least one protrusion which extends outwards in a direction parallel with the plane of the load carrying surface and which, in use, may act to define a spacing between the module and another module against which it is abutted.

Preferably one edge of a tread module is provided with two said protrusions and preferably said protrusions are spaced apart by a distance corresponding to the spacing of support members to which it is intended that the tread module may be secured.

Preferably the tread module load carrying surface comprises a plurality of apertures adapted to accommodate retention means for attachment of the module to a reaction surface such as one defined by a pair of elongate support members and preferably two or more of said apertures are spaced apart by a distance corresponding to the spacing of two or more of said aforementioned protrusions provided at an edge of the tread module.

Preferably the rigidity of the tread module allows it to be supported at two edge regions and, without the need for intervening support, resist deflection when loaded between the edge regions.

The load carrying surface may be provided with texturing for slip resistance purposes. Particularly in the case of a tread module body provided with apertures, and in particular apertures which are for drainage purposes, the present invention teaches that at least some and optionally all of the apertures may be surrounded by at least one small, raised, rib-like formation. Preferably an aperture is surrounded by two or more rib-like formations the ends of which are spaced so that water may drain through that spacing into the aperture. A preferred configuration is that of a square comprising four straight rib sections each spaced from an adjacent section at a corner of the square.

BRIEF DESCRIPTION OF THE DRAWINGS

One embodiment of the present invention will now be described, by way of example only, with reference to the accompanying diagrammatic drawings in which.

DETAILED DESCRIPTION OF THE PREFERRED EMBODIMENTS

A tread module 10 for a walkway or stairway comprises an injection moulded body of glass-filled polyamide and of a substantially rectangular shape having a width direction X a depth direction Y and a thickness in the direction Z.

Figure 1:
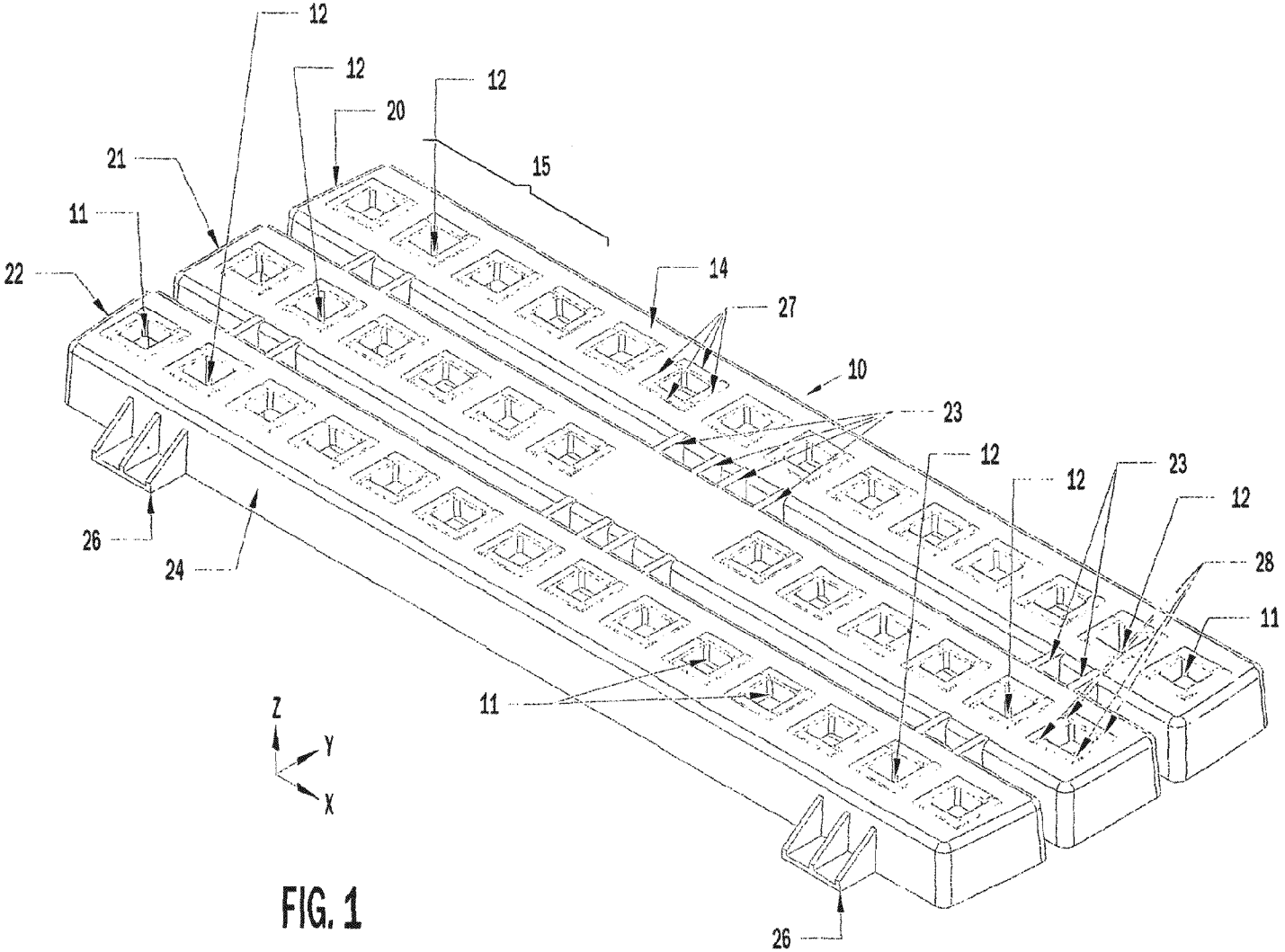
FIG. 1 is a perspective view from above of a tread module in accordance with the present invention.
Figure 2:
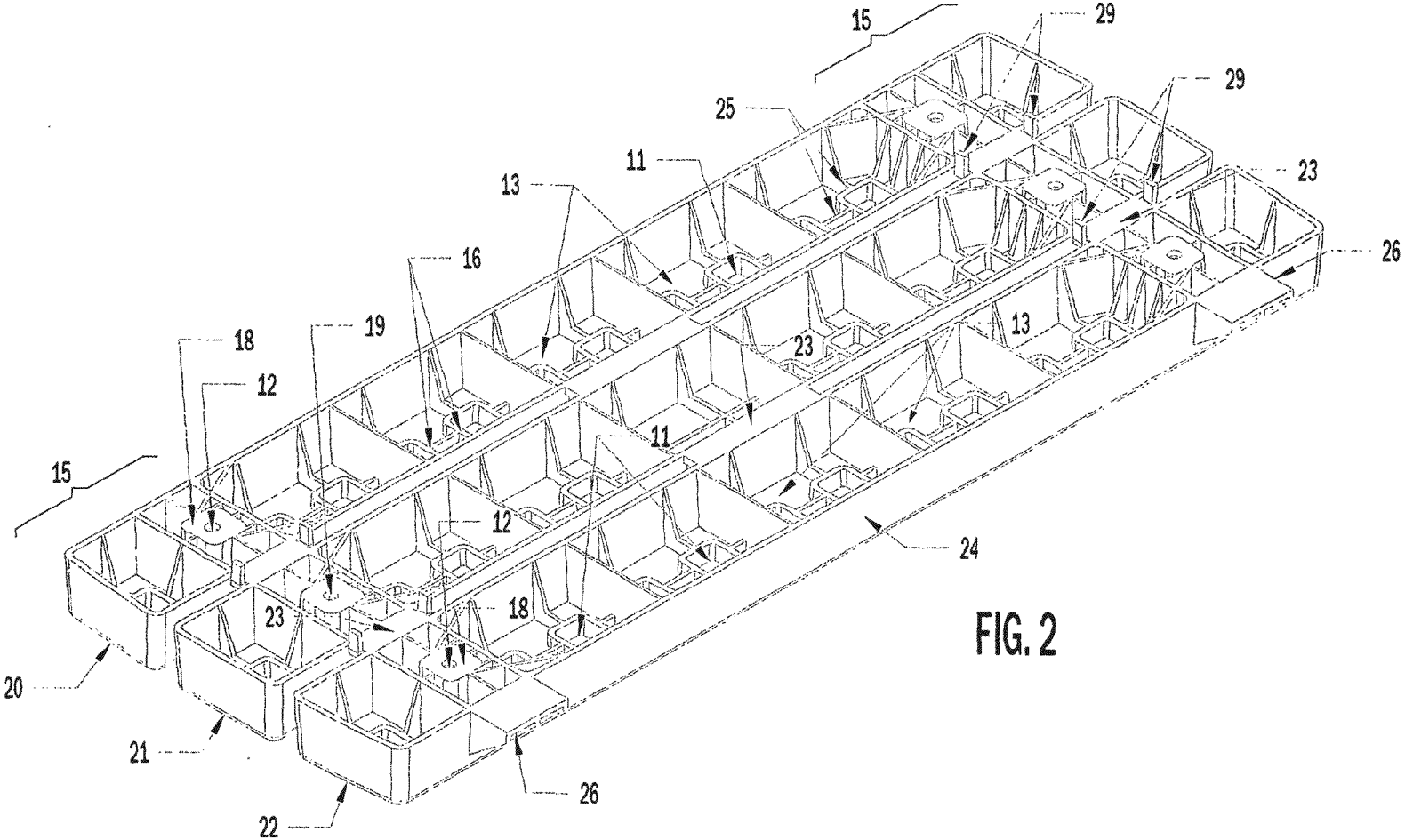
FIG. 2 is a perspective view of the underside of the tread module of FIG. 1.
Figure 3:
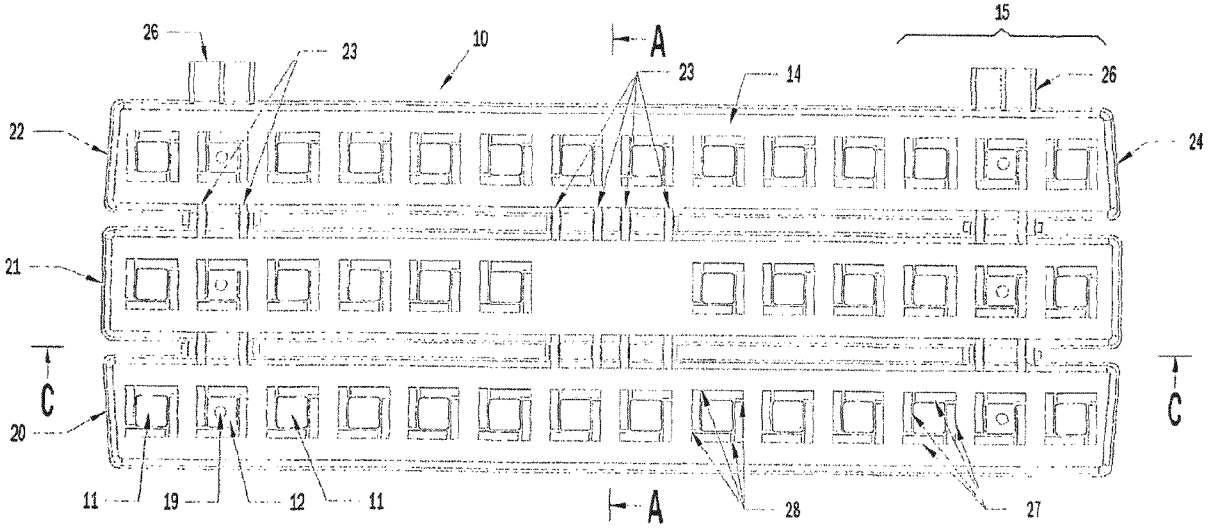
FIG. 3 is a plan view of the tread module of FIG. 1.

The module is of a non-solid formation comprising a plurality of through-apertures 11, 12 and a plurality of recess regions 13 which open at an underside surface of the module (see FIGS. 2 & 3). Each of the apertures extends from an upper, load carrying surface 14 of the body and is of substantially square profile in plan as viewed in FIG. 3.

A majority of the apertures serve as drainage apertures 11 but at each edge region 15 there are three retention apertures 12 for receiving retention means such as a self-tapping screw 9 by means of which the tread module may be secured to a supporting structure, typically to a pair of extruded aluminium beams which extend in the direction Y and are spaced apart by a distance corresponding to the spacing of the apertures 12 across the width X of the module.

Figures 5, 6, 7, 8:
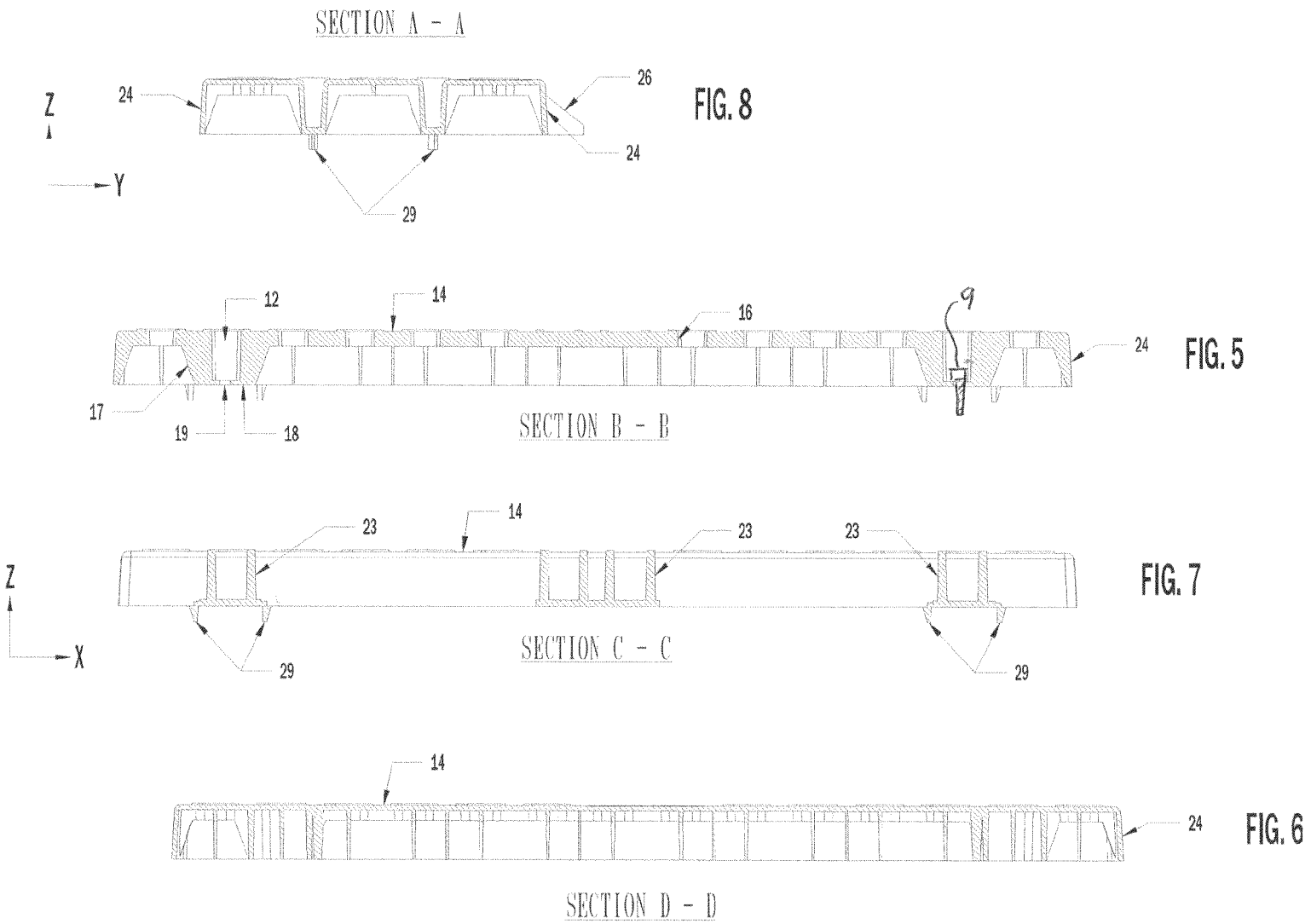
FIG. 5 is a section on the line B-B of FIG. 4.
FIG. 6 is a section on the line D-D of FIG. 4.
FIG. 7 is a section on the line C-C of FIG. 3.
FIG. 8 is a section on the line A-A of FIG. 3.

The wall 16 of each drainage aperture is defined by a tubular formation which extends from and is moulded integrally with the material which defines the load carrying surface 14 (see FIGS. 2 & 5). The apertures 11 each extends part way through the thickness of the module in the direction Z.

Figure 4:
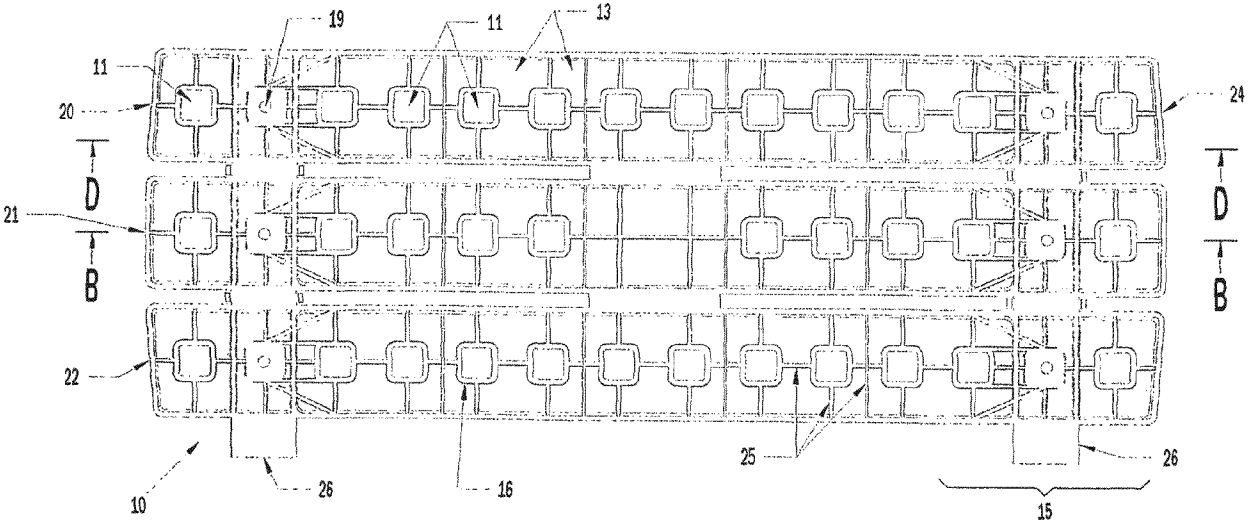
FIG. 4 shows the underside of the tread module of FIG. 1.

The retention apertures 12 similarly are formed by tubular formations which extend from and are moulded integrally with the load carrying surface, and have a wall thickness 17 as best seen by reference to FIGS. 4 and 5. The aperture 12 extends through the entire thickness of the module in the direction Z.

The retention apertures 12 are substantially closed at a lower end by a shoulder formation 18 provided with a central aperture 19 for the retention screw 9, the annular shoulder 18 providing an abutment surface against which the head of the retention member may firmly bear.

The tread module 10 comprises three rows of apertures 11, 12 each extending in the width direction X and each associated with a respective one of three sections 20, 21 & 22 of the load carrying surface 14.

Each of the load carrying surface sections 20, 21, 22 and the associated apertures defines a sub-module section which is inter-connected to an adjacent sub-module section by integrally moulded and severable connecting webs 23.

Each of the sub-modules 20, 21, 22 has integrally moulded therewith a flange formation 24 which depends from the periphery of the load carrying surface section and has a length in the thickness direction Z corresponding to that of the apertures 12.

Reinforcing webs 25 (see FIGS. 2 & 4) extend between adjacent apertures 11, 12 and between each aperture and confronting surfaces of the flange 24 thereby to provide a reinforcing function.

One of the longer edges which extends in the width direction of the tread module is provided with a pair of spacers 26 which extend outwards from the flange formation 24. Each spacer 26 is aligned with a respective one of the two series of retention apertures 12 whereby, in use when the tread module is supported by a pair of spaced beams extending under the apertures 12, those spacers will each overlie a respective beam.

Slip-resistance for the load carrying surface 14 is enhanced by surrounding each of the apertures 11, 12 with four rib-like formations 27 arranged in a square formation and with one end of each formation spaced slightly from the side of another rib formation thereby to provide small drainage paths 28 for flow of water from the surface of the load carrying surface into an aperture 11.

To assist location of the tread modules on pairs of support beams of a standardised size and spacing, pairs of projections 29 (see FIGS. 2, 7 & 8) may extend downwards from the underside surface of the module. The projections optionally may be positioned to extend from those of the severable webs 23 which are aligned with the retention apertures 12.

Optionally the apertures at each end of some or each of the rows of apertures, i.e. onwards of the retention apertures 12, may be provided with coloured or reflective inserts thereby to provide users with a safety indication of the useable extent of a walkway or stairway formed using the modules 10.

Figure 9:
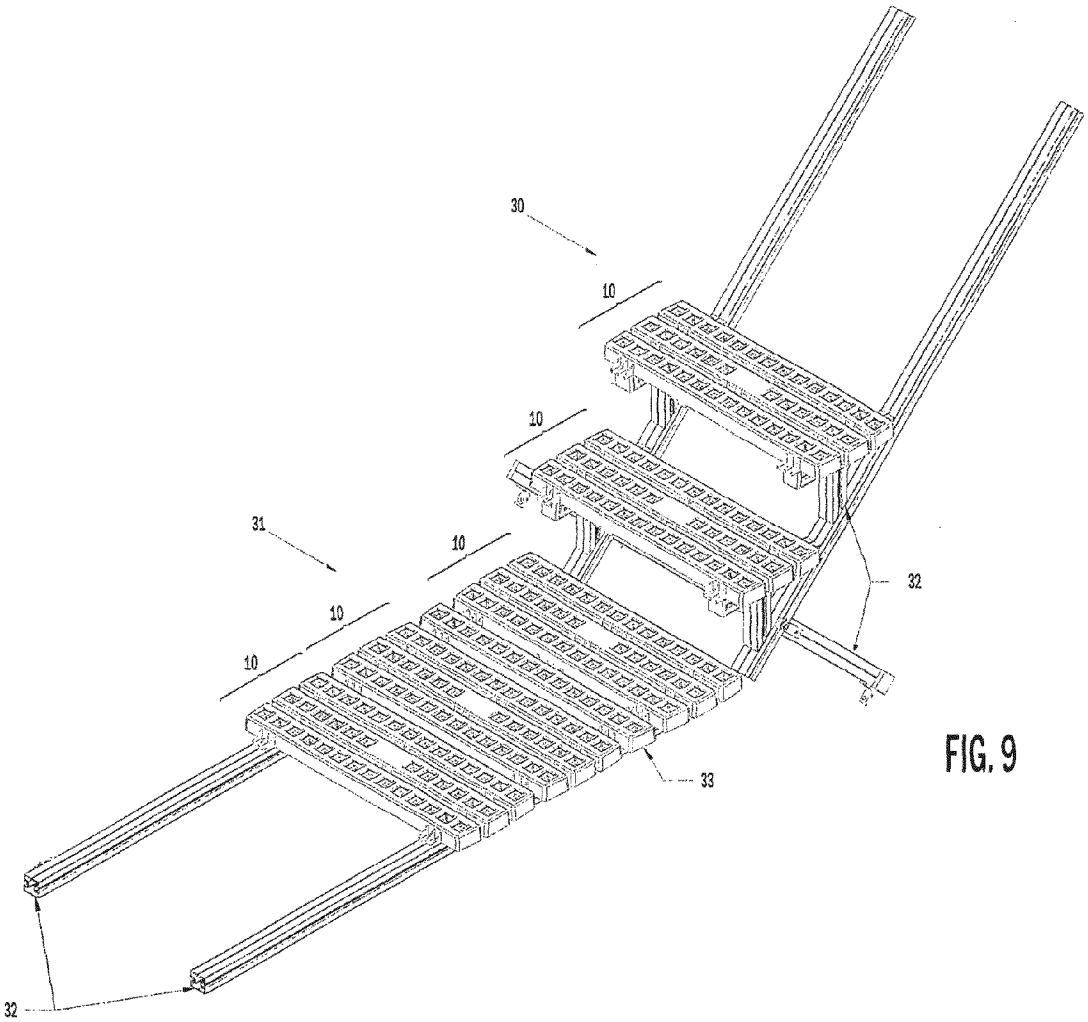
FIG. 9 is a perspective view of part of an installation comprising tread modules in accordance with the present invention.

FIG. 9 shows an installation comprising a stairway 30 formed from a plurality of the tread modules 10 and a walkway 31 similarly formed from a plurality of the modules and in addition a sub-module 32 formed by severing one of the modules 10 to provide a module of a third the depth of the full module 10 thereby to provide a substantially continuous walkway over a distance which is slightly greater than that which can be wholly occupied by an integral number of the complete modules 10. The modules are secured by means of self tapping screws to transversely spaced tubular support beams 32 and are each unsupported between the beams.

The invention claimed is:

1. A tread module for a walkway or stairway having a body of material which defines a load-carrying surface, said tread module comprising:

at least two sub-module sections severable with respect to each other and which are formed integrally with one another and interconnected by at least one severable connecting web formation, the tread module being reduced in size by severance of the at least one severable connecting web formation, each of the sub-module sections having an edge formation, the edge formation being a flange that extends from an entire periphery of a load-carrying surface of the severable sub-module section to define, together with an underside of the load-carrying surface, a recess region open at the underside surface, the edge formation partially defining an underside surface of the body that is substantially parallel to the load-carrying surface, the body being provided with a plurality of apertures that extend through the body from the load-carrying surface, ends of at least some of the apertures partially defining the underside surface of the body, the at least one severable connecting web formation extending from the flange of one of the sub-module sections to the flange of another of the sub-module sections, and at least one of the sub-module sections comprising at least one edge protrusion that extends outwards from the flange of the respective sub-module section in parallel with a plane of the load-carrying surface, the edge protrusion defining a spacing between the tread module and another tread module or a sub-module section against which the edge protrusion abuts, wherein at least some of said apertures each locate a retention device by which the tread module is configured to be secured to a supporting structure, and said apertures for location of the retention devices each provide a reaction surface for a head of the retention device such that the retention device is configured to be accommodated within the apertures without protruding above the load-carrying surface.

2. The tread module according to claim 1, wherein the at least one severable connecting web formation is provided substantially midway between two substantially opposite edges of a body of substantially square or other rectangular shape, and severance of the at least one severable formation results in provision of two tread modules of equal dimensions in a direction between said opposite edges.

3. The tread module according to claim 1, wherein the at least one severable connecting web formation is provided between two parallel, opposite edges of a body of substantially square or other rectangular shape at a position off-set from midway between the edges, the tread module being divided to provide two or more sub-module sections of different sizes.

4. The tread module according to claim 1, wherein the tread module comprises three sections severable from one another such that the tread module is configured to be severed to provide one of (1) two sub-module sections, one of the sub-module sections being two thirds of the depth of the tread module and the other sub-module section being one third of the depth of the tread module, or (2) to provide three sub-module sections, each of the three sub-module sections being one third of the tread module.

5. The tread module according to claim 1, wherein the tread module is of a substantially rectangular shape having a width greater than depth and is severable into two or more sub-module sections each having a greater width-to-depth ratio than that of the tread module from which the two or more sub-module sections are formed.

6. The tread module according to claim 1, wherein at least some of said apertures act as drainage channels for drainage of water from the load-carrying surface.

7. The tread module according to claim 1, wherein the body of the tread module comprises reinforcing web sections which extend between neighboring apertures and/or between the apertures and a flange formation which at least partially surrounds said apertures.

8. The tread module according to claim 1, wherein two of the edge protrusions are provided and spaced apart by a distance corresponding to spacing of support members to which the tread module is configured to be secured.

9. The tread module according to claim 8, wherein the tread module comprises retention apertures configured to accommodate means for retaining for attachment of the tread module to a support surface, at least two of said retention apertures being spaced apart by a distance corresponding to spacing of said two edge protrusions.

10. The tread module according to claim 1, wherein the tread module is of a substantially rectangular shape having a width greater than a depth to provide longer and shorter edges, said tread module being severable into two or more of the sub-module sections, each of the two or more sub-module sections having the width of the tread module, and only one of the longer edges of the tread module being provided with one or more edge protrusions such that severance of the tread module provides one sub-module section having said edge protrusion and another sub-module section devoid of the edge protrusion.

11. The tread module according to claim 1, further comprising apertures extending therethrough, each of the apertures being surrounded by two or more rib-like formations having ends spaced such that water is able to drain through the spacing into the aperture.

12. A tread module according to claim 1, wherein two of the sub-module sections are interconnected by a plurality of severable connecting webs.

13. A tread module according to claim 1, wherein the body of material which defines the load-carrying surface is a body of molded material.

14. A tread module according to claim 1, wherein the body of material which defines the load-carrying surface is a body of cast material.

15. A tread module according to claim 1, wherein the body of material which defines a load-carrying surface is substantially rigid.

16. A tread module according to claim 15, wherein said body is substantially rigid in each of two mutually perpendicular directions.

17. A tread module according to claim 1, further comprising pairs of projections which extend from the underside surface of the tread module to assist with location of the tread module on a pair of support beams.

18. A walkway or stairway, comprising:

a pair of elongate support members which extend substantially parallel with one another and spaced apart from one another; and a plurality of tread modules according to claim 1 configured to extend over and be secured to the support members.

19. The walkway or stairway according to claim 18, wherein the spacing of the protrusions of each tread module corresponds to the spacing of the elongate support members.

20. A tread module for a walkway or stairway having a body of material which defines a load-carrying surface, said tread module comprising:

at least two sub-module sections severable with respect to each other and which are formed integrally with one another and interconnected by at least one severable connecting web formation, the tread module being reduced in size by severance of the at least one severable connecting web formation, each of the sub-module sections having an edge formation, the edge formation being a flange that extends from an entire periphery of a load-carrying surface of the severable sub-module section to define, together with an underside of the load-carrying surface, a recess region open at the underside surface, the edge formation partially defining an underside surface of the body that is substantially parallel to the load-carrying surface, the body being provided with a plurality of apertures that extend through the body from the load-carrying surface, ends of at least some of the apertures partially defining the underside surface of the body, the at least one severable connecting web formation extending from the flange of one of the sub-module sections to the flange of another of the sub-module sections, and at least one of the sub-module sections comprising at least one edge protrusion that extends outwards from the flange of the respective sub-module section in parallel with a plane of the load-carrying surface, the edge protrusion defining a spacing between the tread module and another tread module or a sub-module section against which the edge protrusion abuts, wherein at least some of said apertures locate a retention device by which the tread module is configured to be secured to a supporting structure, said apertures for location of the retention device provide a reaction surface for a head of the retention device such that the retention device is configured to be accommodated within the apertures without protruding above the load-carrying surface, and the apertures for location of the retention device are of a stepped shape in cross-section to define between the ends of each of the apertures an annular abutment surface which lies in a plane substantially parallel with the load carrying surface of the module.

21. A walkway or stairway, comprising:

a pair of elongate support members which extend substantially parallel with one another and spaced apart from one another; and a plurality of tread modules according to claim 20 configured to extend over and be secured to the support members.

* * * * *